US006658121B1

(12) United States Patent
König

(10) Patent No.: US 6,658,121 B1
(45) Date of Patent: Dec. 2, 2003

(54) HEADPHONE HAVING AN ADJUSTABLE LOCALIZATION OF AUDITORY EVENTS

(76) Inventor: Florian Meinhard König, Schellenbergstr. 7, D-82110 Germering (DE)

( * ) Notice: Subject to any disclaimer, the term of this patent is extended or adjusted under 35 U.S.C. 154(b) by 648 days.

(21) Appl. No.: 09/620,513

(22) Filed: Jul. 20, 2000

(30) Foreign Application Priority Data

Jul. 20, 1999 (DE) ..... 199 33 378

(51) Int. Cl.[7] ..... H04R 5/02; H04R 25/00; H04R 1/02; H05R 5/00

(52) U.S. Cl. ..... 381/309; 381/370; 381/182; 381/354; 181/146

(58) Field of Search ..... 381/309, 74, 182, 381/370, 371, 372, 351, 352, 353, 354; 181/146, 151, 166, 198

(56) References Cited

U.S. PATENT DOCUMENTS 4,965,836 A * 10/1990 Andre et al. ..... 381/370
6,073,723 A * 6/2000 Gallo ..... 181/151

FOREIGN PATENT DOCUMENTS

EP 484354 5/1992

* cited by examiner

*Primary Examiner*—Forester W. Isen
*Assistant Examiner*—Devona E. Faulk
(74) *Attorney, Agent, or Firm*—Collard & Roe, P.C.

(57) ABSTRACT

The invention relates to a headphone with one right housing and one left housing, which are associated with a user's ears. These housings are provided-with acoustic baffles in which there. are disposed dynamic sound transducers, each of which comprises a tweeter and a mid/woofer disposed coaxially therewith. To ensure that the localization of auditory events reproduced by this headphone can be controlled selectively, the acoustic baffle in each housing is provided with a first high damping portion which, relative to the center of the sound transducer, covers a region of more than 170 degrees and less than 340 degrees of the mid/woofer. The remaining region is a cutout for the tweeter and leaves uncovered a substantially V-shaped region with an apex angle of smaller than 170 degrees and larger than 20 degrees. There is also a second high damping portion, which is disposed in the region of the apex of the V-shaped region which leaves between 5% and 50% of the tweeter covered.

10 Claims, 2 Drawing Sheets

HEADPHONE HAVING AN ADJUSTABLE LOCALIZATION OF AUDITORY EVENTS

BACKGROUND OF THE INVENTION

1. Field of the Invention

The invention relates to a headphone with two housings, comprising one right housing and one left housing, each of which are associated with the user's ears. These housings contain acoustic baffles which have dynamic sound transducers, each of which comprises a tweeter and a mid/woofer disposed coaxially therewith.

2. Description of the Prior Art

Stereo headphones normally contain an arrangement of acoustic baffles at a center region of a housing of the headphones. This conventional arrangement has a design disadvantage because the auditory events produced thereby are perceived by a user to be localized in an upper part of the user's head, with some differentiation in a rearwardly directed hemisphere. This means that auditory events or sounds intended to simulate a stage located in front of a user are not localized frontally during reproduction or the playing of music via a conventional stereo headphone. This conflicts with the normal human hearing sensation, explaining why much of the listening public refuses to use headphones because they sound unnatural.

In-head localization of auditory events is caused when using headphones that cause ear and body reflections during sound reception via headphones. However, in this case, perceived comb-filtered audio effects cannot be processed by the ear, since they are not supplied thereto.

This drawback can be overcome by mixing the missing comb-filtered audio effects into the signal supplied to the headphone. This necessitates very complex circuitry. In addition, to overcome this drawback, the headphones must be adapted to the individual ear of the user to achieve satisfactory frontal localization by the headphones.

The prior art establishes a design for headphones of a completely different nature for creating frontal localization by stereo headphones, as disclosed in European Patent EP 0484354 B1. According to this proposal, the headphones that produce comb-filtered audio effects needed for frontal localization contain a plurality of sound transducer systems in both headphone housings in a position shifted forward and down by predetermined amounts in the direction of sight. This position is compared with the conventional arrangement wherein sound transducer systems are in a central region on the outer envelope of the ears. Because of this relatively simple design the localization in the upper part of the head that was previously experienced is transformed into a hearing event that can be localized substantially horizontally toward the front.

Headphones working according to this principle for frontal localization of auditory events have proved effective in overcoming the drawbacks of the prior art. However, for small-sized headphones, such as headphones which rest on the ear as in the case of the Walkman™ and similar devices, it is not as easy to arrange the acoustic baffles in a position shifted forward and down.

SUMMARY OF THE INVENTION

One object of the present invention is to overcome the above-mentioned disadvantage and to provide front localization with simple means, even for small headphones, without the use of electronics.

Another object of the invention is to provide a headphone with controllable localization of an auditory event.

Yet another object of the invention is to provide a surround headphone with frontal localization of the front channels and of a middle channel and localization of surround channels separated therefrom.

To achieve the foregoing objectives, the present invention provides a headphone that permits control of the localization of auditory events reproduced with the headphone by producing comb-filtered audio effects. This comb-filtering is generated by selective shadowing of the radiated sound, and is based on the frequency response of the reproduced sound. This comb-filtered effect can be achieved by using a headphone of small or ultra-small size, since the coaxial acoustic baffles are disposed in a conventional manner in the headphone and the control of the localization of the auditory event is achieved by selectively covering or damping regions of the mid/woofer and of the tweeter.

A stereo headphone for frontal localization of auditory events contains transmissive regions or shadowed regions of the acoustic baffles which are disposed so that the sound is selectively radiated downward. Hereby there is frontal localization in the same quality as with the first embodiment of inventor's proposal to dispose acoustic baffles shifted forward and down compared with the conventional arrangement.

The invention also provides for a surround headphone having frontal localization of the front stereo middle channels and separate localization of the rear and side channels, such as the surround channels. Starting from the stereo headphone with frontal localization, a second set of acoustic baffles is disposed in a mirror image position in a horizontal plane relative to the first set of acoustic baffles on a horizontal plane relative to the user's head. Thus, the surround channels can be localized separately from the stereo/middle channels. Nevertheless, this design represents an extremely simple expedient for effectively differentiating sound fields reproduced by headphones.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

DETAILED DESCRIPTION OF THE PREFERRED EMBODIMENT

Figure 1:
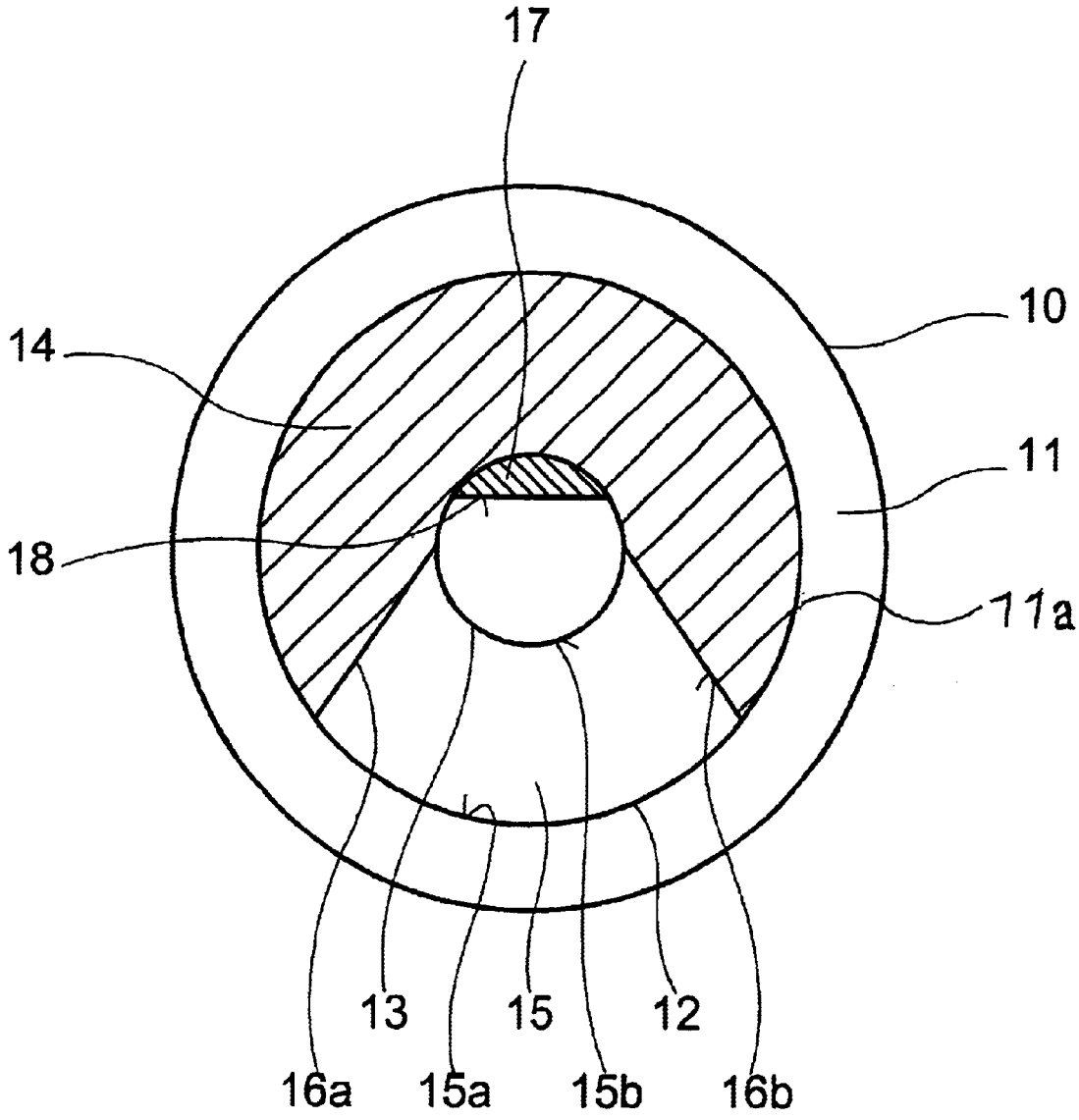
FIG. 1 shows a top view of an acoustic baffle of one of two housings of a headphone, which can be used as a stereo headphone with frontal localization.

FIG. 1 shows the top view of an acoustic baffle 10 in which each baffle is disposed in the right housing and in the left housing of a stereo headphone. In the illustrated embodiment the acoustic baffle has the form of a substantially circular plate. Alternatively, acoustic baffle 10 can also be designed as an ellipse. Within its inner rim, which is impervious to sound, acoustic baffle 10 comprises portions of high acoustic damping and portions of free acoustic transmissivity. For the present purposes, the term free acoustic transmissivity can also characterize portions of substantially less damping compared with the portions of high damping but not completely unobstructed acoustic transmissivity. In addition, in this case, the term damping is to be understood here as acoustic damping.

On a rear side of acoustic baffle 10 shown in FIG. 1, there is disposed a coaxial sound transducer system comprising a mid/woofer 12 and a tweeter 13. Mid/woofer 12 naturally has a larger diameter than tweeter 13, and inwardly it directly adjoins inner rim 11*a* of acoustically impervious circular region 11 of acoustic baffle 10. Tweeter 13 is disposed at the center of mid/woofer 12. In addition to the cutout for tweeter 13, acoustic baffle 10 contains a first high damping portion disposed between its circular outer contour and the circular outer contour of mid/woofer 12, which corresponds to the inner rim 11*a* of circular region 11. Relative to the center of acoustic baffle 10 first high damping portion 14 extends over an arc of more than 170° and less than 340°, leaving a generally V-shaped or trapezoidal region 15 uncovered. Region 15 has zero damping or only slight damping compared with high damping portion 14. This V-shaped region 15 has an apex angle of smaller than 170° and larger than 20°, preferably smaller than 100° and larger than 50°. In a preferred embodiment, this angle is about 70°. In FIG. 1, first high damping portion 14 is bounded by straight rims 16*a* and 16*b*, which laterally define trapezoidal region 15. Trapezoidal region 15 is also defined at an outer end by an arc 15*a* and at its small base by an arc 15*b* adjacent to tweeter 13. Rims 16*a*, 16*b* end inwardly at that rim of tweeter 13 corresponding to the V-shaped region not covered by first high damping portion 14.

First high damping portion 14 provides a sound produced by mid/woofer 12 that reaches the ear of a user wearing the stereo headphone exclusively or for the most part exclusively via V-shaped region 15. This has the advantage in that a relatively large area, namely the area of portion 14 and the area of inner rim 11*a*, functions as the acoustic baffle for the bass and middle frequencies.

Tweeter 13 is also partly covered, specifically by a second portion 17 of high damping. This portion 17 is disposed in the region of the apex of V-shaped region 15, and it leaves covered between 5% and 50%, preferably between 5% and 25% of the tweeter. However in the preferred embodiment it leaves about 15% of the tweeter uncovered. This design ensures that the major part of the sound radiated by tweeter 13 reaches the ear of a user wearing the stereo headphone without obstruction, while this fraction of the sound is directed substantially downward. It is assumed that the user is wearing the stereo headphone so that acoustic baffle 10 has the orientation shown in FIG. 1, with the uncovered part of tweeter 13 pointing downward and the apex of V-shaped region 15 pointing upward. Practical experience has shown that, by such selective shadowing of the radiated auditory event, the in-head localization which occurs in conventional headphones is transformed into localization of the auditory event in front of the head of a user of the stereo headphone.

As shown in FIG. 1, second portion 17 of high damping, which is disposed in front of tweeter 13, is bounded by a straight rim 18, which is disposed approximately in a horizontal plane relative to the user's head when the stereo headphone is in use.

Figure 2:
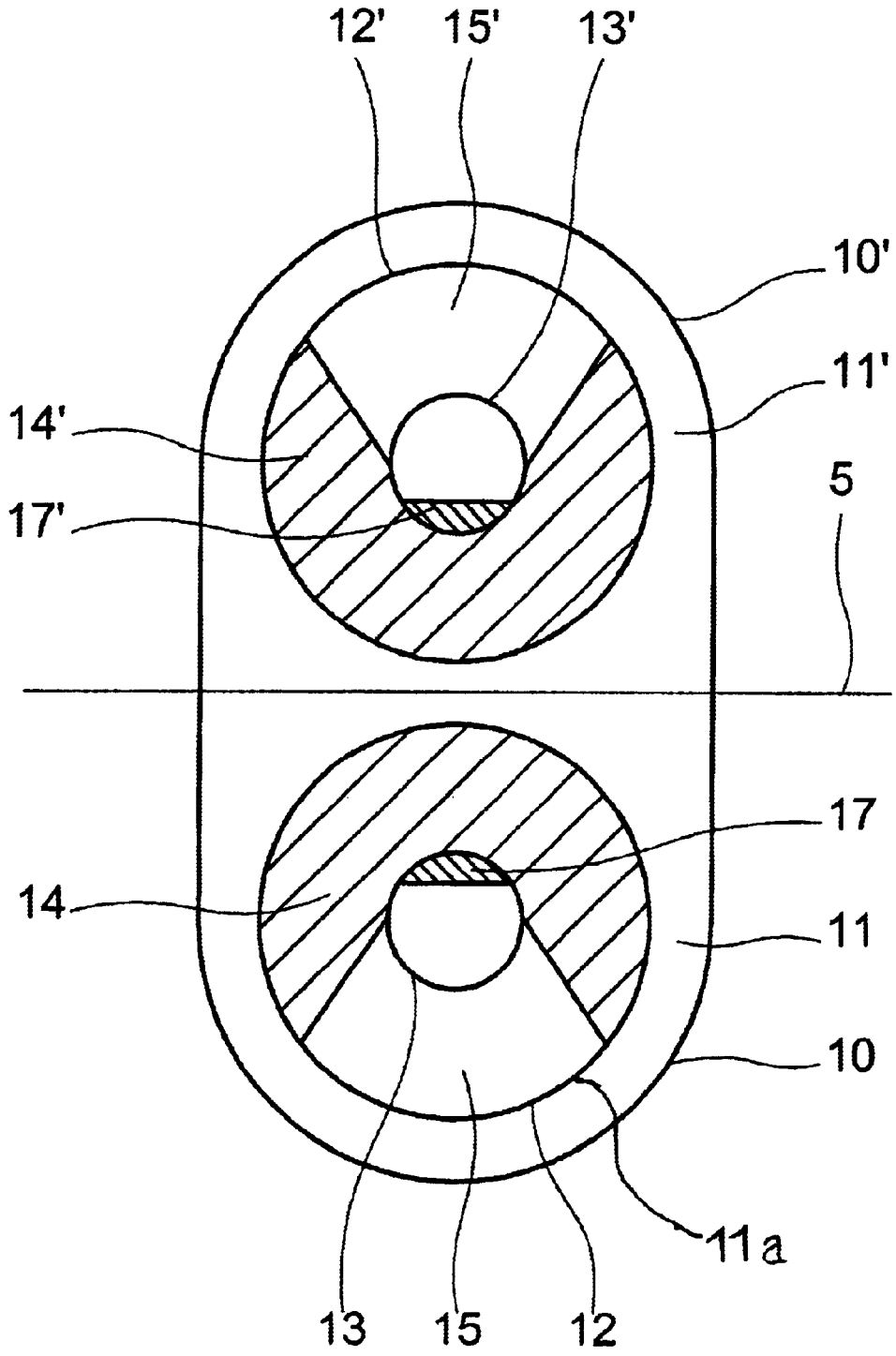
FIG. 2 shows a top view of an acoustic baffle of one of two housings of a headphone, which can be used as a surround headphone with frontal localization.

FIG. 2 shows a surround sound version of the headphone shown in FIG. 1, in which there is a twin coaxial acoustic baffle system. Like parts in FIG. 1 and FIG. 2 are represented by the same reference numerals.

The sound transducer unit of FIG. 1 shown as mid/woofer and tweeter 12, 13 respectively is "reflected" along a mirror plane S in FIG. 2, thus creating a second sound transducer unit 12', 13'. This second sound transducer unit 12' and 13' has the same internal structure as first sound transducer unit 12, 13, even regarding the portions of high damping, but which is turned upside down relative thereto. This means that the apex of V-shaped region 15' of second sound transducer unit 12', 13' points downward toward the apex of V-shaped region 15 of first sound transducer unit 12, 13, while second portion 17' of high damping points toward second portion 17 of high damping of first sound transducer unit 12, 13, so that the uncovered, weakly damped or undamped regions of second sound transducer unit 12', 13' point upward in FIG. 2.

A headphone constructed on the basis of FIG. 2 can be used as a surround headphone, wherein first sound transducer unit 12, 13 radiates the sound for a front channel or the front middle channel, whereas second sound transducer unit 12', 13' radiates a surround channel. Thus this design ensures that the front channels or the front middle channel of a surround sound field can be localized in front of the user's head, while the surround channels can be localized substantially in a plane disposed behind as well as to the side of the user's head.

Accordingly, while several embodiments of the present invention have been shown and described, it is obvious that many changes and modifications may be made thereunto without departing from the spirit and scope of the invention.

What is claimed is:

1. A headphone having a right housing and a left housing, each housing being associated with a user's ear wherein each housing comprises:

a) at least one acoustic baffle;

b) at least one dynamic sound transducer disposed within be said at least one acoustic baffle, and each transducer having a tweeter and a mid/woofer disposed coaxially therewith;

c) a first high damping portion disposed within said at least one acoustic baffle, and disposed relative to a center region of said at least one dynamic sound transducer, wherein said first high damping portion covers a region of more than 170 degrees and less than 340 degrees of said mid/woofer except for a cutout for said tweeter, wherein said cutout forms substantially a V-shaped region left uncovered by said first high damping portion, said substantially V-shaped region having an apex region having an angle of smaller than 170 degrees and larger than 20 degrees; and d) a second high damping portion, which is disposed in said apex region of said V-shaped region, wherein said second high damping portion leaves between 5% and 50% of said tweeter covered.

2. A headphone according to claim 1, wherein said V-shaped region of said first high damping portion has an apex angle of smaller than 100 degrees and larger than 50 degrees.

3. A headphone according to claim 1, wherein said V-shaped region of said first high damping portion has an apex angle of approximately 70 degrees.

4. A headphone according to claim 1, wherein said second high damping portion leaves said tweeter between 5% and 25% uncovered.

5. A headphone according to claim 1, wherein said second high damping portion leaves approximately 15% of said tweeter uncovered.

6. A headphone according to claim 1, wherein said first high damping portion and said second high damping portion comprises materials that are optimized for damping audio events radiated by said mid/woofer and said tweeter respectively.

7. A headphone according to claim 1, wherein said second high damping portion is bounded by a straight line pointing to a center region of said tweeter, wherein said line intercepts each leg of said V-shaped region of said first high damping portion at a substantially similar angle.

8. A headphone according to claim 1, wherein when the headphone is disposed in a use position, said V-shaped region of said first high damping portion flares downward and said apex region thereof points upward, said second high damping portion leaves uncovered a lower region of said tweeter which is disposed in said apex region, wherein this design creates a stereo headphone with frontal localizations of an auditory event.

9. A headphone according to claim 8, wherein said at least one dynamic sound transducer forms a first dynamic sound transducer unit, including said first high damping portion and said second high damping portion of the acoustic baffle, which is used for transmission of a set of stereo/middle channels, and further comprising a second dynamic sound transducer unit, including a first high damping portion and a second high damping portion of an acoustic baffle, used for transmission of a series of surround channels, the two sound transducer units being offset relative to one another in a shared acoustic baffle, said V-shaped region of said first high damping portion of said first dynamic sound transducer unit flaring downward and said apex thereof pointing upward when said headphone is disposed in said use position, said second high damping portion designed to leave uncovered said lower part of said tweeter which is disposed in said apex region, and said V-shaped region of said first high damping portion of said second dynamic sound transducer unit flaring upward and said apex region thereof pointing downward when the headphone is disposed in said use position, said second high damping portion leaving said lower region of said tweeter uncovered which is disposed in said apex region, the headphone for use as a surround headphone with frontal localization of front stereo/middle channels and rear/side localization of surround channels.

10. A headphone according to claim 9, wherein when the headphone is in use position, said second dynamic sound transducer unit is disposed above said first dynamic sound transducer unit.

* * * * *

UNITED STATES PATENT AND TRADEMARK OFFICE

CERTIFICATE OF CORRECTION

PATENT NO. : 6,658,121 B1
DATED : December 2, 2003
INVENTOR(S) : König

It is certified that error appears in the above-identified patent and that said Letters Patent is hereby corrected as shown below:

Column 4,
Line 35, before the word "said" please delete the word "be".

Signed and Sealed this

First Day of June, 2004

JON W. DUDAS
*Acting Director of the United States Patent and Trademark Office*